US005960368A

United States Patent [19]

Pierce et al.

[11] Patent Number: 5,960,368

[45] Date of Patent: Sep. 28, 1999

[54] METHOD FOR ACID OXIDATION OF RADIOACTIVE, HAZARDOUS, AND MIXED ORGANIC WASTE MATERIALS

[75] Inventors: Robert A. Pierce, Aiken, S.C.; James R. Smith, Corrales, N.M.; William G. Ramsey; Connie A. Cicero-Herman, both of Aiken, S.C.; Dennis F. Bickford, Folly Beach, S.C.

[73] Assignee: Westinghouse Savannah River Company, Aiken, S.C.

[21] Appl. No.: 08/861,483

[22] Filed: May 22, 1997

[51] Int. Cl.[6] ..... G21F 9/00

[52] U.S. Cl. ..... 588/10; 588/11; 588/18; 210/758

[58] Field of Search ..... 588/10, 11, 18, 588/20; 210/758

[56] References Cited

U.S. PATENT DOCUMENTS

| | | | |
|---|---|---|---|
| 3,161,601 | 12/1964 | Barton | 252/644 |
| 3,365,578 | 1/1968 | Grover et al. | 250/493.1 |
| 3,957,676 | 5/1976 | Cooley et al. | 588/18 |
| 4,039,468 | 8/1977 | Humblet et al. | 588/20 |
| 4,049,779 | 9/1977 | Ropp | 423/309 |
| 4,087,511 | 5/1978 | Ropp | 423/277 |
| 4,351,749 | 9/1982 | Ropp | 588/11 |
| 4,460,500 | 7/1984 | Hultgren | 588/10 |
| 4,483,789 | 11/1984 | Kunze et al. | 588/3 |
| 4,530,723 | 7/1985 | Smeltzer et al. | 521/29 |
| 4,632,778 | 12/1986 | Lehto et al. . | |
| 4,732,705 | 3/1988 | Laske et al. . | |
| 4,770,783 | 9/1988 | Gustavsson et al. | 588/3 |
| 4,834,915 | 5/1989 | Magnin et al. | 588/3 |
| 4,847,008 | 7/1989 | Boatner et al. | 588/11 |
| 4,847,219 | 7/1989 | Boatner et al. | 501/27 |
| 4,892,685 | 1/1990 | Magnin et al. | 588/3 |

(List continued on next page.)

FOREIGN PATENT DOCUMENTS

| | | |
|---|---|---|
| 61-270700 | 8/1986 | Japan . |
| 63-210700 | 2/1987 | Japan . |
| 2130783 | 6/1984 | United Kingdom . |

OTHER PUBLICATIONS

Oki, et al., "Voume reduction of flame–resisting radioactive wastes by new wet oxidation process,": Waste Management, Waste Isolation in the U.S., Technical Programs and Public Education 2:463–468 (1984) (Roy G. Post, General Chairman Editor).

Pierce and Smith, "Nitric–Phosphoric Acid Oxidation of Orangic Waste Materials (U)," presented at athe ASME Mixed Waste Symposium, Baltimore, Maryland WSRC–MS–95–0080 (Aug., 1995).

Pierce, et al., "Nitric–Phosphoric Acid Oxidation of Solid and Liquid Organic Materials (U)," presented at the Waste Managment Symposium, Tucson, Arizona WSRC–MS–95–0009 (1995).

(List continued on next page.)

*Primary Examiner*—Ngoclan Mai

*Attorney, Agent, or Firm*—Bruce D. Gray, Esq.; Dean W. Russell, Esq.; Kilpatrick Stockton LLP

[57] ABSTRACT

The present invention is directed to a process for reducing the volume of low level radioactive and mixed waste to enable the waste to be more economically stored in a suitable repository, and for placing the waste into a form suitable for permanent disposal. The invention involves a process for preparing radioactive, hazardous, or mixed waste for storage by contacting the waste starting material containing at least one organic carbon-containing compound and at least one radioactive or hazardous waste component with nitric acid and phosphoric acid simultaneously at a contacting temperature in the range of about 140° C. to about 210 ° C. for a period of time sufficient to oxidize at least a portion of the organic carbon-containing compound to gaseous products, thereby producing a residual concentrated waste product containing substantially all of said radioactive or inorganic hazardous waste component; and immobilizing the residual concentrated waste product in a solid phosphate-based ceramic or glass form.

20 Claims, 1 Drawing Sheet

U.S. PATENT DOCUMENTS

| | | | |
|---|---|---|---|
| 4,904,416 | 2/1990 | Sudo et al. | 588/3 |
| 5,143,653 | 9/1992 | Magnin et al. | 588/3 |
| 5,288,435 | 2/1994 | Sachse et al. | 264/5 |
| 5,424,042 | 6/1995 | Mason et al. | 422/159 |
| 5,430,233 | 7/1995 | Forrester | 588/236 |
| 5,435,942 | 7/1995 | Hsu | 252/625 |
| 5,457,266 | 10/1995 | Bege et al. | 588/20 |
| 5,461,185 | 10/1995 | Forsberg et al. | 588/11 |

OTHER PUBLICATIONS

Sunagawa, et al., Rep. K2, *Atomic Energy Society of Japan*, (Tokyo, 1985) (unavailable).

Smith, "Air–Nitric Acid Destructive Oxidation of Organic Wastes," presented at athe ACS 5th Symposium of the Emerging Technology in Hazardous Waste Management, Atlanta, Georgia WSRC–MS–93–169 (Sep., 1993).

Sunagawa, et al., "Volume reduction of radioactive wastes by an advanced wet oxidation process," *Trans. Am. Nucl. Soc.*, 50:91–92 (Nov. 10–14, 1985).

Wagh and Singh, "Low–Temperature–Setting Phosphate Ceramics for Stabilization of Low–Level Mixed Waste," pp. 633–635 presented at the International Symposium and Exhibition on Environment Contamination in Central and Eastern Europe, Budapest, Hungary (Sep. 20–23, 1994).

METHOD FOR ACID OXIDATION OF RADIOACTIVE, HAZARDOUS, AND MIXED ORGANIC WASTE MATERIALS

The United States Government has rights in this invention pursuant to Contract No. DEAC0989SR18035 between the U.S. Department of Energy and Westinghouse Savannah River Company.

BACKGROUND OF THE INVENTION

1. Field of the Invention

The present invention relates to a "wet" oxidation process for reducing the volume of hazardous, radioactive, and mixed wastes, and for converting said wastes into a form suitable for storage, particularly long-term storage in a repository. More particularly, the present invention relates to a process for treating waste containing both organic carbon compounds and radioactive or hazardous material to reduce the volume of the material by oxidizing the organic carbon compounds with a combination of nitric acid and phosphoric acid, and then converting the reduced volume waste material into an immobilized final form, such as a glass or ceramic, which can then be stored in a suitable repository.

2. Description of Background and Related Art

The disposal of radioactive, hazardous, and mixed (radioactive and hazardous) waste has over the years become a growing environmental, political, and economic problem. Due to the limited number and capacity of suitable repositories and the political difficulties involved in establishing new repositories, the supply of disposal capacity has decreased. At the same time, increasing amounts of waste material must be disposed of due to nuclear disarmament, increasing awareness of existing waste in short term storage, and the production of new waste material in areas such as nuclear power plant operation and medical research.

A particular area of concern is the disposal of low level radioactive and mixed wastes, such as job control waste (i.e., waste generated by everyday operations in nuclear facilities such as protective gloves, clothing, etc. worn by workers who handle or are possibly exposed to radioactive material), nuclear power plant operations (such as contaminated solutions and ion exchange resins used to remove corrosion from reactor secondary cooling systems), and operations involving treatment and purification of water used to cool stored nuclear material, such as fuel rods (e.g., ion exchange resins). At the present time, over 80% of this type of waste is sent for storage to a single site, which is at or near capacity. As a result of this lack of available storage capacity and the measures taken by political entities to limit the amount of waste storage, costs to store low level waste have increased significantly. In order to reduce these costs, attempts have been made to reduce the amount of waste that must be sent to repositories. One method proposed has been to eliminate some or all of the components of low level waste that are not hazardous or radioactive, and/or convert hazardous components to nonhazardous form.

An additional concern with the storage of any radioactive or hazardous waste is the stability of the final storage form. Such waste must be safely stored for time periods that are often geological in scale, requiring that the material be stored in a form that is stable over time and also over exposure to a variety of conditions. The tendency of storage containers to break down or corrode over time and the resulting risk that the stored material will escape into the biosphere has led to the use of storage forms wherein the waste materials are immobilized in a solid form that is relatively stable toward the expected environments to which the stored material may be exposed. Immobilizing the waste material in a glass (vitrification) or ceramic that is stable over time to the conditions expected to be encountered in a repository are two examples of this approach.

Prior attempts to reduce the volume of hazardous or radioactive waste have involved several different approaches, some of which also involve immobilizing the radioactive material in a solid form.

U.S. Pat. No. 3,957,676 (Cooley et al.) describes treating combustible solid radioactive waste materials with concentrated sulfuric acid at a temperature within the range of 230° C.–300° C., and simultaneously and/or thereafter contacting the reacted mixture with concentrated nitric acid or nitrogen dioxide, in order to reduce the volume of combustible material and convert it into gaseous products.

U.S. Pat. No. 4,039,468 (Humblet et al.) describes an approach of attempting to separate radioactive species using solvent extraction. An organic phosphate-containing solvent is contacted with the waste and then treated by contacting the stream with phosphoric acid, obtaining a light organic phase containing essentially no radioactive material, and heavy aqueous and organic phases which contain essentially all of the radioactive material. The light organic phase can then be combusted, and the concentrated radioactive material can be solidified by reaction on aluminum oxide and incorporation into a glass or resin matrix.

U.S. Pat. No. 4,460,500 (Hultgren) describes reducing the volume of radioactive waste, such as ion exchange resins, by treatment with an aqueous complex forming acid, such as phosphoric acid, citric acid, tartaric acid, oxalic acid, or mixtures thereof to remove the radioactive species from the exchange resins and form a complex therewith. The radioactive species are then adsorbed onto an inorganic sorbent. The resulting material is then dried and calcined in the presence of air or oxygen, resulting in combustion of the organic material. The calcinated material is then collected into a refractory storage container, which is then heated to a temperature at which the material sinters or is fused to a stable product.

U.S. Pat. No. 4,732,705 (Laske et al.) describes treating radioactive ion exchange resin particles with an additive containing anions or cations that reduce the swelling behavior of the resin particles and produces a permanent shrinkage of the resin particles. The additive may be a polysulfide or organic acid ester. The treated resin particles are then immobilized in a solid matrix, such as a cement.

U.S. Pat. No. 4,770,783 (Gustavsson et al.) describes decomposing organic ion exchange resins containing radioactive materials by oxidation in a mixture of sulfuric acid and nitric acid in the presence of hydrogen peroxide or oxygen as an oxidant. Radioactive metals in the resulting liquid are precipitated with hydroxide and separated from the liquid, which contains other non-radioactive materials. The liquid is then released to the environment. The precipitated metal compounds are immobilized in cement.

U.S. Pat. No. 4,904,416 (Sudo et al.) describes centrifuging wet radioactive ion exchange particles to remove water therefrom, then coating the particles with a small quantity of cement powder, and then adding water and cement, in order to increase the loading of resin in the cement. U.S. Pat. No. 5,424,042 (Mason et al.) also describes removing water from radioactive ion exchange resins prior to vitrification.

U.S. Pat. No. 5,457,266 (Bege et al.) suggests dewatering radioactive ion exchange resins by mixing with a calcium compound and heating to a temperature over 120° C. at a pressure of 120 hPa to 200 hPa.

These attempts have not been completely successful because (1) the use of sulfuric acid and other acids to oxidize organic materials included in waste streams does not allow for efficient conversion of the resulting treated waste stream into a stable, immobilized final form, (2) processes involving one or more transfers of radioactive species between solvent or sorbent phases is complicated and inefficient, (3) dewatering and cementation processes do not result in sufficient volume reduction, and (4) processes using high temperatures are not viewed favorably by the nuclear industry for oxidation of materials containing organic compounds.

Prior attempts to immobilize low level radioactive or mixed waste, such as ion exchange resins, have also been made.

U.S. Pat. No. 4,483,789 (Kunze et al.) describes a method for encasing the radioactive ion exchange resin in blast furnace cement. The mixture of resin, cement, and water is disclosed to have a slow initial hardening and high sulfate resistance, and is allowed to harden at room temperature.

U.S. Pat. No. 4,530,723 (Smeltzer et al.) describes a method for forming a solid monolith by mixing radioactive ion exchange resin and an aqueous mixture of boric acid or a nitrate or sulfate salt, a fouling agent, a basic accelerator, and cement, and allowing the cement to harden.

U.S. Pat. No. 4,632,778 (Lehto et al.) describes a process for disposing of radioactive material by adsorbing the radioactive material on an inorganic ion exchanger, mixing the inorganic ion exchanger loaded with radioactive species with a ceramifying substance and baking this mixture to form a ceramic.

U.S. Pat. No. 4,834,915 (Magnin et al.) describes immobilizing radioactive ion exchange resins by saturating them with a base, preferably sodium hydroxide and immobilizing them in a hydraulic binder. U.S. Pat. No. 4,892,685 (Magnin et al.) describes immobilizing radioactive ion exchange resins by first treating them with an aqueous solution containing $NO_3^-$ and $Na^+$ ions to ensure that all of the sites in the resin are saturated, and then adding a hydraulic binder, such as cement. U.S. Pat. No. 5,143,653 (Magnin et al.) describes treating borate containing radioactive ion exchange resins with calcium nitrate prior to incorporation into a hydraulic binder. These three patents are directed to attempting to resolve the problem of ion exchange of radioactive material between the immobilized resin material and the hydraulic binder.

U.S. Pat. No. 5,288,435 (Sachse et al.) describes a process for the incineration and vitrification of radioactive waste materials, which may contain sulfur compounds, by contact of the waste materials with molten glass in a glass melter having an extended heated plenum to allow for sufficient combustion residence times. If sulfur-containing wastes are being processed, the off gases produced can be scrubbed of sulfur, which can then be converted into gypsum.

U.S. Pat. No. 5,435,942 (Hsu) describes treating alkaline radioactive wastes with nitric acid to reduce pH and with formic acid to remove mercury compounds, in order to adjust the glass forming feedstock composition to achieve more efficient glass melter operation.

The use of lead-iron phosphate glasses for the immobilization of radioactive waste is described in U.S. Pat. Nos. 4,847,008 and 4,847,219 (Boatner et al.). The use of glasses to immobilize radioactive waste is also described in U.S. Pat. No. 3,161,601 (Barton), U.S. Pat. No. 3,365,578 (Grover), U.S. Pat. No. 4,351,749 (Ropp), and U.S. Pat. No. 5,461,185 (Forsberg et al.).

These methods of immobilizing radioactive materials are disadvantageous because the volume reduction of waste is inadequate, which results in increased costs for disposing of the organic, non-radioactive materials. In addition, removal of radioactive material is incomplete. Finally, any significant volume reduction that occurs is due to incineration, which creates the risk that radioactive species will be entrained in ash in the off gas.

It is an object of the present invention to avoid the disadvantages of the prior procedures by providing a simple, efficient process for the wet oxidation of organic carbon-containing radioactive, hazardous, or mixed waste products. It is also an object of the present invention to provide a process that results in significant volume reduction of these waste materials, thereby significantly decreasing the costs associated with their long term disposal. It is also an object of the present invention to provide a process whereby the residual concentrated waste product produced by the wet oxidation process is conveniently and easily incorporated into a final form material without special intermediate treatment steps. Finally, it is also an object of the present invention to provide a process for immobilizing radioactive, hazardous, or mixed waste products in a final form that is stable to expected repository conditions over long periods of time.

SUMMARY OF THE INVENTION

The present invention achieves these and other objects of the invention and avoids the disadvantages of prior processes by providing a method whereby a combination of nitric acid and phosphoric acid is used to oxidize organic materials in a low level radioactive, hazardous, or mixed waste stream. The presence of phosphoric acid stabilizes the nitric acid in solution, and the combined acid mixture boils at a temperature that is considerably higher than that of nitric acid alone. This allows the oxidation reaction to be conducted at higher temperatures, resulting in more complete oxidation of the organic components of the waste stream, and resulting in the oxidation of some materials that otherwise cannot be oxidized in a "wet" process.

The organic components are almost entirely converted to gaseous form, with a residual amount that is often on the order of less than 1000 ppm. This considerably reduces the volume of waste that must be placed in a repository, and substantially decreases the cost of waste disposal. In addition, the process according to the present invention avoids problems experienced with other acid systems, in particular with systems containing sulfuric acid and nitric acid, wherein sulfuric acid breaks down the nitric acid to such a degree that the usefulness of the nitric acid is adversely affected and the nitric acid cannot be recovered and recycled. Finally, phosphoric acid as used in the process of the present invention is not as corrosive or harsh on conventional metal process equipment as are other acids, such as sulfuric acid.

The present invention also avoids the necessity of removing phosphorus-containing species from the remaining concentrated waste material prior to placing this material into final, stable form for disposal in a repository. Instead, the phosphorus-containing material is incorporated into the final form of the waste product.

In its broad aspect, the present invention involves preparing radioactive, hazardous, or mixed waste for storage by first contacting the waste starting material, which contains at least one organic carbon-containing compound and at least one radioactive or hazardous waste component, with nitric acid and phosphoric acid simultaneously. This contacting is generally carried out at a contacting temperature in the range of about 140° C. to about 210° C. for a period of time sufficient to oxidize at least a portion, and preferably almost all, of the organic carbon-containing compound to gaseous products or off gas. This removal of the organic carbon-containing compounds produces a residual concentrated waste product containing substantially all of the radioactive or hazardous metal waste component. The residual concentrated waste product is then immobilized in a solid form suitable for disposal in a waste repository. Suitable solid forms include a glass or ceramic matrix containing the immobilized waste, in particular iron phosphate glasses, ferric phosphate ceramics, and magnesium phosphate ceramics.

Other features and advantages of the present invention will be apparent to those skilled in the art from the above Summary, as well as from the following Detailed Description of the Specific Embodiments and the accompanying Drawing.

DETAILED DESCRIPTION OF SPECIFIC EMBODIMENTS

Figure 1:
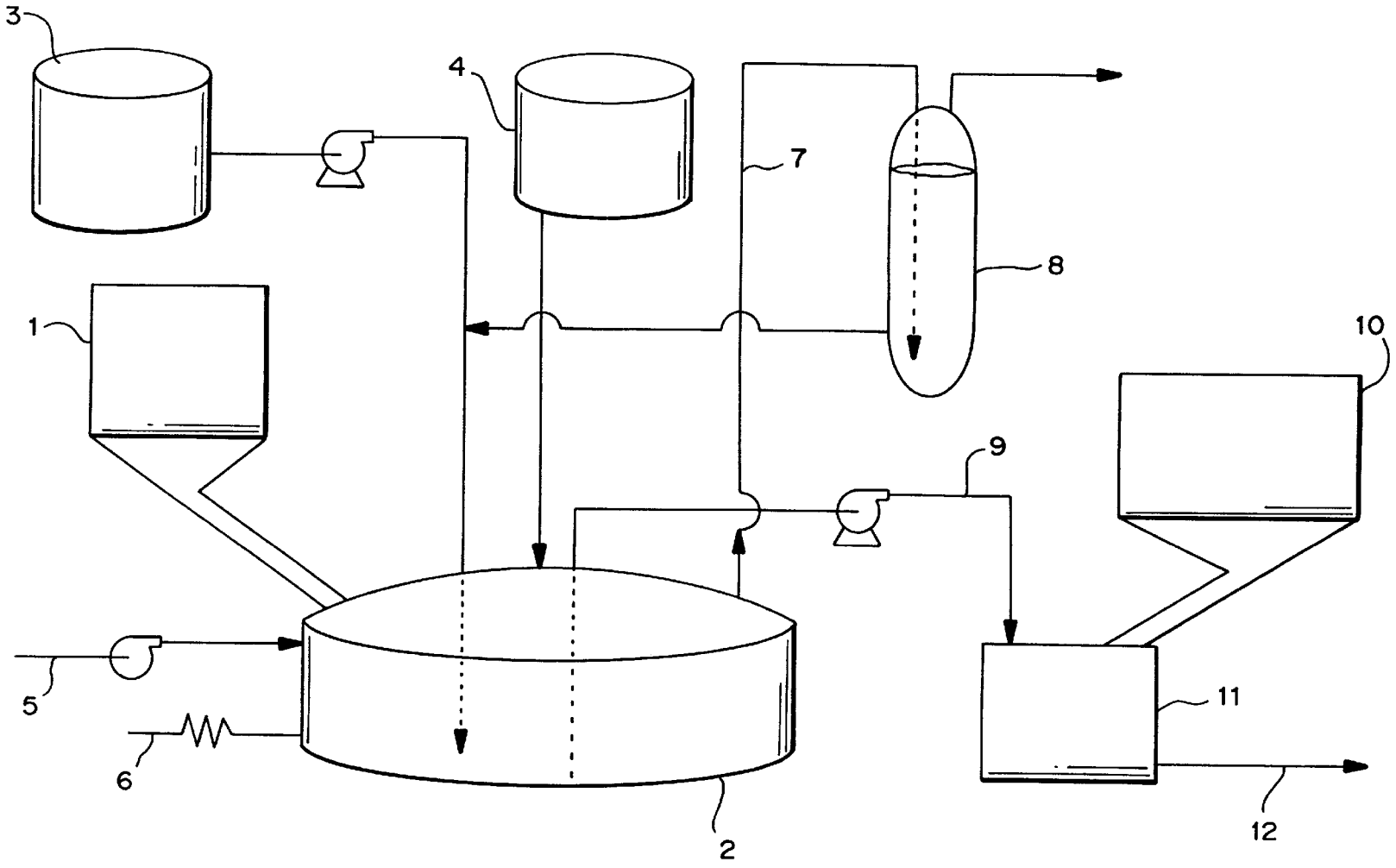
FIG. 1 is a schematic view of one embodiment of the process according to the present invention.

In one embodiment of the present invention, shown in FIG. 1, radioactive, hazardous, or mixed waste feedstocks 1 containing organic carbon compounds are fed to oxidation vessel 2. Nitric acid 3 and phosphoric acid 4 are added to the oxidation vessel 2. Air 5 is not necessary for the operation of the process, but may be optionally pumped in to aid in the oxidation process (in particular, to aid in the recycling of nitric acid) if desired. Heat 6 is added and/or removed as needed to maintain an appropriate oxidation reaction rate. As oxidation of the organic materials occurs in the oxidation vessel, off gases 7 such as carbon monoxide, carbon dioxide, water, HCl, and nitrogen oxides are generated. The nitrogen oxides are optionally converted into nitric acid in nitric acid recovery unit 8. The residual concentrated waste product 9 comprising substantially all of said radioactive or hazardous metal components of the waste feedstock can then be removed from the oxidation vessel and vitrified or ceramified (e.g., by combining with a vitrifying or ceramifying substance or other solidification feed 10) in a melter or other vessel 11 and processed into a final, stable form 12 suitable for disposal in a repository.

The present invention is applicable to a wide variety of radioactive, hazardous, and mixed waste starting materials, but is particularly suitable for treatment of low level radioactive and mixed waste containing organic carbon components. Radioactive waste contains at least one radioactive element, such as U, Th, Cs, Sr, Am, Co, Pu, or any other element that is defined in the waste storage or waste disposal art as radioactive. Hazardous waste contains at least one Resource Conservation and Recovery Act (RCRA) listed hazardous material, such as the metals As, Cd, Cr, Hg, Pb, Se, Ag, Zn, and Ni, or a hazardous organic compound. Mixed waste contains both radioactive and hazardous waste components. These radioactive or hazardous materials may contain these elements in the form of metals, ions, oxides, or other compounds, such as organic compounds. Low level waste generally involves a large quantity of waste material and a small amount of radioactive components contaminating the waste material. The non-radioactive, non-hazardous components of the waste are generally organic carbon-containing compounds, and make up the predominant proportion of the waste.

The organic carbon components which are oxidized by the process of the present invention are present in the waste as any of a variety of organic compounds. Nonlimiting examples include neoprene, cellulose, EDTA, tributylphosphate, polyethylene, polypropylene, polyvinylchloride, polystyrene, oils, resins, particularly ion exchange resins, and mixtures thereof.

The radioactive, hazardous, and mixed waste materials to which the process of the present invention is applied arise from a variety of sources. One source of such waste is job control waste from, e.g., fuel fabrication operations, nuclear power plant maintenance and operations, and hospital, medical, and research operations. This job control waste includes items such as used rubber gloves, paper, rags, glassware, brushes, and various plastics. These items often come into contact with radioactive and/or hazardous material. Although only small quantities of radioactive and/or hazardous material may adhere thereto, large volumes of this material must be disposed of as radioactive or hazardous waste.

Another source of radioactive, hazardous, or mixed organic carbon-containing waste is spent organic ion exchange resins used to purify water in fuel fabrication plants, nuclear reactors, and reprocessing plants. These resins are used for the continuous cleaning of water in cooling circuits, as well as the water in nuclear fuel storage basins, where the resins remove ionic corrosion products which have become radioactive when they pass near the reactor core, and fission products of reactor fuel, such as cesium and strontium ions, that have leaked out of the fuel and into the storage basin water. The resins are typically granulated or sulfonated crosslinked divinylbenzenes.

Yet another source of radioactive, hazardous, or mixed organic carbon-containing waste suitable for the process of the present invention is the aqueous streams used to clean cooling systems in nuclear power plants. These cleaning streams typically contain EDTA and other organic chelating agents to help remove corrosion from the interior surfaces of piping and other process equipment used to provide reactor cooling water in secondary reactor cooling systems. These cleaning streams typically contain iron, cesium, nickel, chromium, and other stainless steel corrosion and erosion products, some of which have become radioactive due to proximity to the reactor core. Cleaning streams containing EDTA typically exit the cooling system containing iron as the primary metal component.

In a nonlimiting example, a suitable waste feedstock material would include solid Pu-contaminated waste of which 60% is combustible, and including, e.g., a mixture of 14% cellulose, 3% rubber, 64% plastic, 9% absorbed oil, 4% resins and sludges, and 6% miscellaneous organics.

In one embodiment of the invention, the nitric acid and phosphoric acid are combined together in varying concentrations prior to introduction to the oxidation vessel. In this case, nitric acid, usually added in a concentration of about 0.25 to 1.5 M, is used in a concentrated phosphoric acid media as the main oxidant. In the resulting mixture, nitric acid is generally present in amounts of about 3% to about 7% by weight, phosphoric acid is present in amounts of about 90% by weight, and the balance (typically a few % by weight) is water. Molar quantities of nitric acid may generally be in the range of about 0.03 to about 2.0, and molar quantities of phosphoric acid may generally be in the range of about 12.8 to about 14.77 moles. The large quantity of phosphoric acid retains the nitric acid in the solution well above its boiling point (i.e., the boiling point of concentrated nitric acid), thereby allowing temperatures of up to 200° C. to be used for the oxidation reaction, and is relatively noncorrosive to most types of stainless steel process equipment at room temperature.

The temperature of the oxidation reaction may be varied depending on the particular composition of the waste feedstock material. In general, the oxidation reaction is carried out at a temperature of from about 140° C. to about 210° C., more particularly about 160° C. to about 180° C. Most organic compounds can be quantitatively oxidized at temperatures below about 175° C. and pressures below about 5 psig. However, some long chain, saturated hydrocarbyl or halohydrocarbyl compounds like polyethylene, polypropylene, and/or polyvinylchloride, require a contacting temperature in the range of about 185° C. to about 190° C., and a pressure in the range of about 10 to about 15 psig. Organic compounds such as neoprene, cellulose, EDTA, tributylphosphate, and nitromethane have been quantitatively oxidized at temperatures below 180° C. at atmospheric pressure.

The concentration of acids and the temperature of oxidation can be varied to obtain reaction rates wherein most organic materials are completely oxidized in under about 1 hour. In general, oxygenated organic materials in the waste feedstock are more easily oxidized than hydrocarbons. While not wishing to be bound be any theory, it is believed that the decomposition of the organic components of the waste material feedstock proceeds by direct oxidation by nitric acid, which is energetically favorable, but very slow due to the difficulties in breaking the carbon-hydrogen bond. It is believed that the oxidation of the organic compounds in the waste feedstock is initiated by dissolved $NO_2$ and NO radicals in solution. For many types of oxygenated organic compounds, the attack by $NO_2$ radical can be first order, as shown below.

$$CH_3(OH)CH_2 + NO_2\bullet \longrightarrow CH_3(OH)CH\bullet + HNO_2 \qquad \Delta H \cong 0$$

$$CH_3CHO + NO_2\bullet \longrightarrow CH_3(O)C\bullet + HNO_2 \qquad \Delta H = -7$$

For aliphatic compounds, higher concentrations of $NO_2$ and NO radicals are needed to obtain comparable oxidation rates.

$$RCH_3 + H_2O + 3NO_2\bullet \longrightarrow RCH_2\bullet + {}_2HNO_2 + HNO_3 \qquad \Delta H \cong -15$$

$$RCH_3 + H_2O + 2NO_2\bullet + NO \longrightarrow RCH_2\bullet + 3HNO_2 \qquad \Delta H \cong -8$$

The organic radicals generated are oxidized or nitrated by the various species in solution, according to the following reactions.

$$RCH_2\bullet + HNO_3 \longrightarrow RCH_2OH + NO_2\bullet \qquad \Delta H \cong -35$$

$$RCH_2\bullet + HNO_2 \longrightarrow RCH_2OH + NO\bullet \qquad \Delta H \cong -42$$

$$RCH_2\bullet + NO_2\bullet \longrightarrow RCH_2NO_2 \text{(nitrated organic)} \qquad \Delta H \cong -52$$

$$RCH_2\bullet + O_2 \text{ (from air)} \longrightarrow RCH_2OO\bullet \qquad \Delta H \cong -3$$

$$RCH_3 + RCH_2OO\bullet \longrightarrow RCH_2\bullet + RCH_2OOH \text{ (organic hydroperoxide)} \qquad \Delta H \cong -12$$

In some of the reactions, the oxidants and/or catalysts $NO_2\bullet$ and NO • are regenerated. Nitration is a major source of oxidation because radical-radical reactions are relatively fast. In water where strong mineral acids are still abundant, such as 14.8 M (85%) $H_3PO_4$, hydrolysis occurs producing an organic carboxylic acid from the nitration products according to the reaction below.

$$RCH_2NO_2 + H_2O + H_3PO_4 \rightarrow RCO_2H + H_2NOH\bullet H_3PO_4 \quad \Delta H \cong -44$$

In process for producing nitrated organic explosive materials, it is known that water can interfere with nitration of the organic species by nitric acid. In such processes, sulfuric acid is often added to the system to tie up water and keep it from interfering in the nitration reaction. Conversely, in the present process, if the reaction solution is allowed to become sufficiently depleted of water, the phosphoric acid might possibly mimic the activity of sulfuric acid, and prevent the remaining water from denitrating the explosive organic species. If this were to occur, nitrated organic species concentration may build up and possibly cause an explosion hazard. This hazard can be reduced by maintaining sufficient water in the system to denitrate any nitrated organic species. Based upon what is known about sulfuric acid and nitric acid, and based upon past experience with the phosphoric acid and nitric acid system of the present invention, it is believed that any explosion hazard can be minimized by maintaining a maximum temperature of 185 to 190° C.

Nitromethane was found to be completely oxidized (101±2%) in a 0.1 M $HNO_3$/14.8 M $H_3PO_4$ solution, when the water content was maintained during the oxidation. Above 130–150° C., any formed organic hydroperoxides should decompose. In fact, complete oxidation of the organic material usually does not occur until these temperatures are reached possibly due to the formation of the relatively stable organic hydroperoxides.

Once carbon chain substitutions begin, hydrogen-carbon bonds on carbon atoms which are also bonded to oxygen are also weakened. As the organic molecules gain more oxygen atoms, they become increasingly soluble in the nitric-phosphoric acid solution. Once in solution, these molecules are quickly oxidized to $CO_2$, CO, and water. If the original organic compound contains chlorine, hydrochloric acid will also be formed.

Relative oxidation rates for various organic compounds in the waste starting material are given below in Table 1. "Fast" oxidation rates denote complete oxidation in less than one hour. "Moderate" oxidation rates denote complete oxidation in 1–3 hours. "Slow" oxidation rates denote complete oxidation in over three hours.

TABLE 1

| COMPOUND | RELATIVE RATE | TEMP. (° C.) | PRESSURE (psig) |
|---|---|---|---|
| Neoprene | Moderate | 165 | 0 |
| Cellulose | Fast | 148 | 0 |
| EDTA | Fast | 140 | 0 |
| Tributylphosphate | Fast | 161 | 0 |
| Resins | Slow | 140 | 0 |
| PE/PP/PVC | Slow | 161–170 | 0 |
| PE | Moderate | 185–190 | 0 |
| PE | Fast | 200–205 | 10–15 |
| PVC | Moderate | 200–205 | 10–15 |
| Benzoic Acid | Fast | 190 | 0 |
| Nitromethane | Fast | 155 | 0 |

Typical throughputs for various waste starting materials (at the specified temperature and pressure conditions) are: EDTA (140° C., 0–5 psig) 142 g/L-hr; Cellulose (150° C., 0–5 psig) 90 g/L-hr; Polystyrene resin (175° C., 5–10 psig) 65 g/L-hr; Neoprene (165° C., 0–5 psig) 50 g/L-hr; and Polyethylene (200° C., 10–15 psig) 35 g/L-hr. Since oxidation of plastics is typically slower than the oxidation of other organic materials in a waste feedstock stream, and since plastics often form the predominant component of the waste feedstock stream, plastics oxidation is often the rate limiting step in the processing of waste feedstock streams.

In one embodiment of the invention, a catalytically effective amount (e.g., 0.001 M) of Pd(II) or other catalyst is added to the oxidation mixture to reduce the proportion of carbon based off gases that is carbon monoxide. This procedure can result in reduction of CO generation to near 1% of released carbon gases.

It is often desirable to recapture nitrogen oxides and convert them back into nitric acid for recycle to the oxidation process, both from a reagent cost standpoint and a pollution reduction standpoint. This can be done using commercially available acid recovery units, and recovery can be improved by introducing air into the oxidation reaction vessel. Air is typically added in amounts that will provide 1–2 moles of $O_2$ per mole of NO gas produced by the process.

Once oxidation is complete and off gases have been removed, the remaining radioactive or hazardous metal components are concentrated in a residual concentrated waste product, which is then removed from the oxidation vessel and placed into a final form where it is immobilized and suitable for long term storage in a suitable repository. Several processes for immobilizing the residual concentrated waste product may be used, including vitrification and ceramification.

When vitrification is used, the residual concentrated waste product is introduced into a melter, which may be heated by induction or other methods. The residual concentrated waste may optionally be combined with an additive (such as ferric oxide). The composition of the glass may be varied depending on the composition of the residual concentrated waste product, but typically will involve adding ferric oxide to form an iron phosphate glass. Typically, iron phosphate glasses are processed using ceramic (e.g., silica, alumina, or mullite) or platinum group metal containers. Glasses produced according to the present invention should contain no less than about 20% $Fe_2O_3$ by weight. Fabrication is difficult if the iron content exceeds 45% (by weight as $Fe_2O_3$). Approximately 4–8% by weight of alkali oxide and about 2–4% by weight of alkaline earth metal oxide is desirably used to help ensure waste solubility. The balance of the system is phosphorus pentoxide $P_2O_5$), and the total $P_2O_5$ content should not be less than about 50% by weight. All percentages are based upon the final glass composition. The phosphate glasses are typically melted at temperatures between about 1050° C. and about 1300° C., more particularly between about 1080° C. and 1200° C. If the melt is stirred, a typical residence time of less than about 1 hour is used. A static melt typically remains in the melter for a residence time of between about 1 and 4 hours.

For example, spent cationic and anionic exchange resins (e.g., sulfonated divinylbenzene polymer, quaternary amine divinylbenzene polymer, or resorcinol resins) suitable for use in purifying water in nuclear facilities can be oxidized according to the present invention by dissolving the resin in the mixed acid oxidizing solution, and the resulting reduced volume product immobilized as a homogeneous glass by adding glass forming additives including 25% by weight of $Fe_2O_3$, 15% by weight $Na_2HPO_4 \cdot 7H_2O$, and 3% by weight of $BaCl_2 \cdot 2H_2O$ at a melt temperature of 1150° C., to yield a glass which provides a two fold volume reduction.

The residual concentrated waste product may also be immobilized in the form of a ceramic, such as magnesium phosphate or ferric phosphate ceramic. These ceramics are formed by acid-base reactions between inorganic oxides and the phosphoric acid solution exiting the oxidation vessel. Phosphate ceramics have low temperature setting characteristics, good strength, and low porosity, and can be produced from readily available starting materials. For instance, a magnesium phosphate ceramic can be made by combining calcined MgO with the phosphoric acid residual waste solution from the oxidation vessel with thorough mixing. The reaction between the acid mixture and the MgO is slightly exothermic, but cooling of the reaction vessel is generally not required. The resulting slurry is poured into a mold and allowed to set. Magnesium phosphate ceramics allow for a relatively high waste loading and a chemically stable, high strength final form. As a nonlimiting example, a magnesium phosphate ceramic may be formed from a mixture of about 33.5 wt % $H_3PO_4$, about 16.5 wt % $H_2O$, about 42.5 wt % MgO, and about 7.5 wt % $H_3BO_3$, where the percentages are based upon the final magnesium phosphate ceramic composition. Since the residual waste solution typically may contain 50–70 wt % $H_3PO_4$ (based upon the residual waste solution), the amounts of water, magnesium oxide, and boric acid may be suitably adjusted to approximate the above composition. It should be understood that the particular composition of the magnesium phosphate ceramic is not critical to the invention, and variations from the above composition are within the scope of the invention.

EXAMPLES

The following Examples 1 through 7 were conducted using the following procedures:

A glass reaction vessel was charged with a mixture of nitric acid and phosphoric acid. Palladium catalyst was also added to help convert CO to $CO_2$. TEFLON fittings and VITON o-rings were used to help create gas seals. The system temperature and pressure were measured using standard methods.

Example 1

2.15 grams of disodium EDTA was added to 34 mL of mixed nitric and phosphoric acid containing 1.5 molar $HNO_3$ and 13.3 molar $H_3PO_4$ at 140° C. and atmospheric pressure. Completion of oxidation was measured by converting any carbon monoxide produced to carbon dioxide and monitoring the total amount of carbon dioxide produced and comparing this amount to the theoretical yield of carbon dioxide based upon the amount of EDTA added to the reaction mixture. Complete oxidation of the organic materials occurred in less than one hour.

Example 2

A solution of 480 mL of disodium EDTA (16.6% by weight) and $Fe_2O_3$ (4.1% by weight) in water (79.3% by weight) was gradually added to 100 mL of mixed nitric and phosphoric acid, the nitric acid concentration of which varied between 0.25 molar and 1 molar, and phosphoric acid concentration of which varied between 14.55 molar and 13.8 molar, at 165° C. and atmospheric pressure. After 8 hours, the resulting residual concentrated waste solution was heated at 200° C. to form 60 mL of iron phosphate ceramic.

Example 3

1.01 grams of cellulose was added to 32 mL of mixed nitric and phosphoric acid having a concentration of 1.5 molar $HNO_3$ and 13.3 molar $H_3PO_4$ at 155° C. and 0–2 psig. Complete oxidation of the organic components occurred in less than one hour.

Example 4

0.12 grams of polyethylene was added to 25 mL of mixed nitric and phosphoric acid having a concentration of 0.25 molar $HNO_3$ and 14.55 molar $H_3PO_4$ at 200° C. and 10–15 psig. Complete oxidation of the organic components occurred in less than two hours.

Example 5

0.15 grams of polyvinylchloride was added to 25 mL of mixed nitric and phosphoric acid having a concentration of 0.25 molar $HNO_3$ and 14.55 $H_3PO_4$ at 190° C. and 10–15 psig. Complete oxidation of the organic components occurred in approximately two hours.

Example 6

4.01 grams of divinylbenzene ion exchange resin was added to 200 mL of mixed nitric and phosphoric acid having a concentration of 1 molar $HNO_3$ and 13.8 molar $H_3PO_4$ at 175° C. and 5–10 psig. Complete oxidation of the organic components occurred in less than two hours.

Example 7

360 mL of radioactively contaminated ion exchange resin was gradually added to 100 mL of mixed nitric and phosphoric acid whose concentration varied between 0.25 molar and 1.0 molar $HNO_3$ and 14.55 molar and 13.8 molar $H_3PO_4$. The resulting residual concentrated waste solution was then combined with ferric oxide (30% by weight), $NaCO_3$ (5% by weight), $Na_2O$ (5% by weight), BaO (2% by weight) and $P_2O_5$ (balance) and heated to 1150° C. for about 1.5 hours to form 60 mL of iron phosphate glass.

Example 8

Approximately 120 mL of spent resin used in the cleaning basin water from the reactor facilities at Savannah River Site were dissolved in 100 mL of the mixed acid solution of Example 7. Analyses of the resin solution indicated that it contained the species shown below in Table 2

TABLE 2

| SPECIES | CONTENT |
|---|---|
| Al | 130 ppm |
| B | 11.1 ppm |
| Ca | 451 ppm |
| Cd | 2.7 ppm |
| Cr | 9.3 ppm |
| Cu | 6.7 ppm |
| Fe | 191 ppm |
| Mg | 31 ppm |
| Na | 6582 ppm |
| Ni | 22.4 ppm |
| P | 174,260 ppm |
| Si | <2.7 ppm |
| Zn | 16.5 ppm |
| $Cl^-$ | 1776 ppm |
| $F^-$ | 274 ppm |
| $NO_3^-$ | 27,236 ppm |
| $PO_4^{3-}$ | <1000 ppm |
| $SO_4^{2-}$ | 15,865 ppm |
| alpha | $9.4 * 10^4$ dpm/mL |
| Beta/Tritium | $3.1 * 10^5$ dpm/mL |
| Cs-137 | $6.29 * 10^{-2}$ μCi/mL |
| Tritium | $2.31 * 10^{-2}$ μCi/mL |

The resulting oxidation solution was mixed with glass forming additives $BaCl_2 \cdot 2H_2O$, $Fe_2O_3$, and $Na_2BPO_4 \cdot H_2O$ and heated to 1150° C. at a rate of approximately 5° C./minute, and melted at 1150° C. for 4 hours to form a homogeneous black glass having the composition set forth below in Table 3.

TABLE 3

| OXIDE | AMOUNT (WT %) |
|---|---|
| $Al_2O_3$ | 2.649 |
| $B_2O_3$ | 0.013 |
| BaO | 2.796 |
| CaO | 0.262 |
| $Cr_2O_3$ | 0.162 |
| $Fe_2O_3$ | 34.007 |
| $La_2O_3$ | 0.023 |
| $Na_2O$ | 0.233 |
| $Nd_2O_3$ | 0.142 |
| NiO | 0.066 |
| $P_2O_5$ | 58.383 |
| PbO | 0.173 |
| $SiO_2$ | 0.199 |
| SrO | 0.007 |
| Total | 99.116 |

A gamma PHA of this glass indicated a Cs-137 content of $4.22*10^{-2}$ μCi/g, or a total of 1.181 μCi. Based on the analyses of the spent resin, indicating that $6.29*10^{-2}$ μCi/mL or a total of 1.037 μCi of Cs-137 were present in the solution stabilized in the glass, Cs-137 was retained in the glass. Standard PCT leaching tests were performed on the glass, resulting in an average measured release of 0.031 g/L P, 0.002 g/L Ba, 3.104 g/L Na, and 0.000 g/L Fe, at a measured leachate pH of 6.00. These values are much lower than the EA accepted value for HLW borosilicate glass. A TCLP extraction using a modified EPA protocol was performed to determine the amount of RCRA metal leaching. The modification consisted of using ground glass, approximately 150 μm, instead of the specified <1 cm glass specimen size, and was made due to the small amount of glass produced and the conservative results that would be obtained by using a large leaching surface area. Results indicated that Ba was the only metal to leach in an amount (1.049 ppm) above the analytical detection limits. This amount is much lower than any of the EPA allowable limits.

It will be apparent to those skilled in the art that many changes and substitutions can be made to the specific embodiments disclosed herein without departing from the spirit and scope of the present invention as set forth in the claims.

What is claimed is:

1. A process for preparing radioactive, hazardous, or mixed waste for storage, comprising:

(A) contacting radioactive, hazardous, or mixed waste starting material comprising at least one organic carbon-containing compound and at least one radioactive or hazardous waste component with nitric acid and phosphoric acid for a period of time sufficient to oxidize at least a portion of said organic carbon-containing compound to gaseous products, thereby producing a residual concentrated waste product comprising substantially all of said radioactive or hazardous metal waste components; and (B) immobilizing said residual concentrated waste product in a solid phosphorus-containing ceramic or glass form.

2. The process according to claim 1, wherein said radioactive, hazardous, or mixed waste starting material comprises low level radioactive waste or low level mixed waste.

3. The process according to claim 2, wherein said low level radioactive waste or low level mixed waste comprises material selected from the group consisting of job control waste, ion exchange resins, and reactor coolant system cleaning streams.

4. The process according to claim 3, wherein said organic carbon-containing compound is selected from the group consisting of neoprene, cellulose, EDTA, tributylphosphate, polyethylene, polypropylene, polyvinylchloride, polystyrene, oils, resins, and mixtures thereof.

5. The process according to claim 1, wherein said radioactive or hazardous waste component contains an element selected from the group consisting of U, Th, Cs, Sr, Am, Co, Tc, Hg, Pu, Ba, As, Cd, Cr, Pb, Se, Ag, Zn, and Ni.

6. The process according to claim 5, wherein said radioactive waste component is Pu.

7. The process according to claim 1, wherein said nitric acid and said phosphoric acid are present in molar quantities of about 0.03 to about 2.0 moles of $HNO_3$ and of about 12.8 to 14.77 moles of $H_3PO_4$.

8. The process according to claim 1, wherein oxygen is provided by introducing air into a mixture of said radioactive, hazardous, or mixed waste starting material, said nitric acid and said phosphoric acid.

9. The process according to claim 1, wherein said contacting temperature is in the range of about 140° C. to about 210° C.

10. The process according to claim 1, wherein said organic carbon-containing compound is selected from the group consisting of polyethylene, polypropylene, and polyvinylchloride, said contacting temperature is in the range of about 185° C. to about 190° C., and wherein said contacting is carried out at a pressure in the range of about 10 to about 15 psig.

11. The process according to claim 1, wherein said gaseous products comprise carbon oxides, water, and nitrogen oxides.

12. The process according to claim 11, further comprising oxidizing said nitrogen oxides to form nitric acid and recycling said nitric acid to said contacting step.

13. The process according to claim 11, wherein said carbon oxides comprise carbon monoxide and carbon dioxide, and wherein said carbon monoxide formation is suppressed by the presence of a catalytic amount of a $Pd^{+2}$ containing catalyst.

14. The process according to claim 1, wherein said immobilizing said residual concentrated waste product in a solid phosphorus-containing ceramic or glass form comprises preparing an iron-phosphate waste glass comprising said radioactive or hazardous waste component stabilized in a matrix of iron-phosphate glass.

15. The process according to claim 14, wherein preparing said iron-phosphate waste glass comprises mixing said residual concentrated waste product, iron oxide, and a glass former, and vitrifying said mixture at a temperature between about 1050° C. and about 1300° C.

16. The process according to claim 1, wherein said immobilizing said residual concentrated waste product in a solid phosphorus-containing ceramic or glass form comprises preparing a magnesium phosphate ceramic from said residual concentrated waste product.

17. The process according to claim 16, wherein said preparing said magnesium phosphate ceramic comprises mixing said residual concentrated waste stream with magnesium oxide and boric acid to form a slurry, and allowing the slurry to set.

18. The process according to claim 1, wherein said immobilizing said residual concentrated waste product in a solid phosphorus-containing ceramic or glass form comprises preparing a ferric phosphate ceramic from said residual concentrated waste product.

19. The process according to claim 1, wherein substantially all of said organic carbon-containing compound is oxidized into gaseous components.

20. A process for preparing radioactive, hazardous, or mixed waste for storage, comprising:

(A) contacting radioactive, hazardous, or mixed waste starting material comprising at least one organic carbon-containing compound and at least one radioactive or hazardous waste component with nitric acid and phosphoric acid for a period of time sufficient to oxidize at least a portion of said organic carbon-containing compound to gaseous products, thereby producing a residual concentrated waste product comprising substantially all of said radioactive or hazardous metal waste components; and (B) immobilizing said residual concentrated waste product in a solid form, wherein said solid form comprises a glass or ceramic matrix selected from the group consisting of iron phosphate glass, ferric phosphate ceramic, and magnesium phosphate ceramic.

* * * * *

UNITED STATES PATENT AND TRADEMARK OFFICE

CERTIFICATE OF CORRECTION

PATENT NO. : 5,960,368
DATED : September 28, 1999
INVENTOR(S) : Robert A. Pierce, *et al.*

It is certified that error appears in the above-indentified patent and that said Letters Patent is hereby corrected as shown below:

Column 11, line 67, delete "$Na_2BPO_4H_2O$" and insert -- $Na_2HPO_4H_2O$ --

Signed and Sealed this

Twenty-second Day of May, 2001

*Attest:*

Nicholas P. Godici

NICHOLAS P. GODICI

*Attesting Officer*

*Acting Director of the United States Patent and Trademark Office*